US007097055B2

(12) United States Patent
Sommerfeld

(10) Patent No.: US 7,097,055 B2
(45) Date of Patent: Aug. 29, 2006

(54) LONG BUFF SHORT DRAFT TRAVEL DRAFT GEAR FOR USE IN A 24.625 INCH POCKET

(76) Inventor: Howard Sommerfeld, 5947 Essex Rd., Oak Forest, IL (US) 60452

( * ) Notice: Subject to any disclaimer, the term of this patent is extended or adjusted under 35 U.S.C. 154(b) by 0 days.

(21) Appl. No.: 10/928,843

(22) Filed: Aug. 27, 2004

(65) Prior Publication Data

US 2006/0043045 A1 Mar. 2, 2006

(51) Int. Cl.
*B61G 9/02* (2006.01)

(52) U.S. Cl. ..... 213/31

(58) Field of Classification Search ..... 213/7, 213/8, 31, 32 R, 33, 75 R
See application file for complete search history.

(56) References Cited

U.S. PATENT DOCUMENTS 3,447,693 A 6/1969 Cardwell
4,305,514 A * 12/1981 Zanow et al. ..... 213/43
5,529,194 A * 6/1996 Merker et al. ..... 213/32 C
5,590,797 A * 1/1997 Duffy et al. ..... 213/33
6,446,820 B1 * 9/2002 Barker et al. ..... 213/75 R

FOREIGN PATENT DOCUMENTS

GB 947333 1/1964
WO WO 2005/073047 8/2005

* cited by examiner

*Primary Examiner*—S. Joseph Morano
*Assistant Examiner*—Robert J. McCarry, Jr.
(74) *Attorney, Agent, or Firm*—James Ray & Assoc.

(57) ABSTRACT

A friction-type draft gear assembly includes a housing having an open front end and a closed rear end forming a ledge to fit into a 24.625 inch draft gear pocket. The front portion incorporates an integral yoke portion with a pair of key slots for attachment to the coupler. A coupler follower is disposed within open front end and communicates with a pair of apertures during buff and draft travel. A compressible cushioning means is positioned within the second end with a seating arrangement abutting an end wall thereof and is extended longitudinally toward the open front end. A friction cushioning element is provided in the open front end of the housing. A spring release mechanism is adapted for continuously urging the friction cushioning element outwardly from the compressible cushioning means thereby releasing such friction cushioning element after compression of such draft gear assembly.

13 Claims, 4 Drawing Sheets

LONG BUFF SHORT DRAFT TRAVEL DRAFT GEAR FOR USE IN A 24.625 INCH POCKET

CROSS-REFERENCE TO RELATED APPLICATIONS

This application is closely related to co-pending U.S. application Ser. No. 10/927,911 filed on Aug. 27, 2004 and entitled "Housing for Long Travel High Capacity Friction Draft Gear Assembly", to co-pending U.S. application Ser. No. 10/927,910 filed on Aug. 27, 2004 and entitled "Long Travel High Capacity Friction Draft Gear Assembly", filed concurrently herewith. These applications are assigned to the assignee of the present invention and the disclosures of these copending applications are incorporated herein by reference thereto.

FIELD OF THE INVENTION

The present invention relates, in general, to friction-type draft gear assemblies for use in cushioning both buff and draft shocks normally encountered by railway rolling stock during make-up and operation of a train-consist on a track structure and, more particularly, this invention relates to a friction-type draft gear assembly having a longer travel distance in buff condition and, yet more particularly, the instant invention relates to a friction-type draft gear assembly having an integral yoke portion for direct attachment to a coupler of the railway car.

BACKGROUND OF THE INVENTION

The following background information is provided to assist the reader to understand the environment in which the invention will typically be used. The terms used herein are not intended to be limited to any particular narrow interpretation unless specifically stated otherwise in this document.

Friction type draft gear assemblies widely used in United States railway industry to provide protection to a railway car by absorbing shocks in both draft and buff conditions must meet various Association of American Railroads (AAR) requirements. In one aspect draft gear must be capable of maintaining the minimum shock absorbing capacity during its service life required by AAR standard M-901-G to be at least 36,000 foot pounds being measured during a drop hammer test. In the other aspect AAR mandates working action of such draft gear to be achieved without exceeding a 500,000 pound reaction pressure acting on the freight car sills in order to prevent upsetting the coupler shank. In a further aspect, the draft gear must fit into a standard AAR railway car pocket of 24.625 inches in length.

The commonly used draft gears, installed in alignment with a railway car center sill, include a housing having an open front and a closed rear portions. A compressible cushioning means is positioned within the rear portion of the housing. A friction cushioning element is adopted in the front portion of the housing. The draft gears further include a spring release mechanism for continuously urging the friction cushioning element outwardly from the compressible cushioning means thereby releasing such friction cushioning element after compression of such draft gears. The compressible cushioning means is typically either of an all spring configuration as taught by U.S. Pat. Nos. 5,152,409 and 5,590,797, of a spring and hydraulic assembly combination as taught by U.S. Pat. No. 3,368,698, or of an elastomeric pad stack as taught by U.S. Pat. Nos. 6,488,162 and 6,446,820.

All standard steel housing draft gears presently fitting in the AAR standard 24.625-inch pocket have a nominal 3.25-inches of travel. This travel applies to each buff and draft conditions for a total travel distance of 6.50-inches. This 6.50-inches of total travel is spelled out in the various M-901 specifications. The only exception presently on the market is an all elastomeric device called the Twin-Pac as taught by U.S. Pat. No. 6,446,820. This design uses a housing with integral yoke and two different stacks of elastomeric pads divided by a spacer plate. In draft only the front stack of pads is loaded, however in buff both stacks of pads are loaded. This design allows for a different amount of draft and buff travel but still falls within the 6.5-inches of total travel required by the specification. Because the resilient compression members in the Twin-Pac draft gear are made exclusively from elastomeric material, the design has several drawbacks, including high recoil forces that cause the cars to bounce back and forth during an impact. This bouncing is also possible in normal train line action. Additionally, testing indicated that such draft gear assembly was damaged during testing when subjected to a higher buff impact loads which are applicable during operation of the railway vehicle.

Therefore, in the first aspect, it is desirable to provide a friction draft gear assembly with an integral yoke portion having a more reliable operation.

In most, if not all cases, impact energy levels during buff conditions are much higher than the train line energy levels during draft conditions. Therefore, in the second aspect, it would be appreciated that any device used to control energy should be able to absorb more energy in buff rather then in draft while fitting into AAR standard 24.625-inch pocket.

SUMMARY OF THE INVENTION

The present invention provides a friction draft gear assembly for railway car stock having a higher shock absorbing capacity, having a 4.75 inch buff travel distance, a 1.25 inch draft travel distance and an integral yoke portion while fitting into a standard 24.625 inch long draft gear pocket within the center sill. The draft gear assembly comprises a housing closed at one end and open at the opposed end. The housing has a dual rear chamber adjacent the closed end and a front chamber adjacent the open end which is in open communication with the dual rear chamber. The dual rear chamber enables employment of the longer spring elements to achieve a buff travel of 4.75 inches and, more importantly, to achieve such buff travel of 4.75 while fitting into the draft gear pocket. A yoke portion extends from the open end and contains either a pair of key slots or a pair of key holes for attachment to the coupler. A pair of apertures is provided adjacent the yoke portion for enabling travel of a coupler follower during friction draft gear assembly operation.

A compressible cushioning element extends longitudinally from the second rear portion toward the open front end and may be at least one spring, a hydraulic assembly, a well known elastomeric pad stack or any combination thereof.

The friction draft gear assembly has a pair of laterally spaced opposed friction surfaces located in the front chamber of the housing.

A seat means with at least a portion of one surface thereof abutting the opposite end of the hydraulic compressible cushioning means is mounted to move longitudinally within the housing for respectively compressing and releasing the hydraulic compressible cushioning means during application and release of a force on the draft gear assembly.

A friction cushioning means is positioned at least partially within the front chamber of the housing for absorbing energy during application of a force sufficient to cause a compression of the draft gear assembly. The friction cushioning means includes a pair of laterally spaced stationary outer plates, which have an outer friction surface engaging the laterally spaced friction surfaces carried by the housing. The outer friction surface includes at least one recessed area to reduce the frictional surface engaging area between the stationary outer plate and the laterally spaced friction surface carried by the housing, and at the same time decrease relative movement between such stationary outer plate and the housing.

A pair of laterally spaced movable plates having at least a portion of an outer friction surface movably and frictionally engaging an inner friction surface of the stationary outer plate and one edge engaging the seat means.

A pair of laterally spaced tapered stationary plates have an outer friction surface movably and frictionally engaging at least a portion of an inner friction surface of the movable plate.

A pair of laterally spaced wedge shoes having at least a portion of an outer friction surface movably and frictionally engaging at least a portion of an inner friction surface of the tapered stationary plate and at least a portion of one edge engaging the seat means. The pair of wedge shoes have a first predetermined tapered portion of 4.5 degrees engaging the matching tapered portion of the stationery tapered plates.

A center wedge having a pair of matching predetermined tapered portions of 45 degrees for engaging a second tapered portion of the wedge shoe to initiate frictional engagement of the friction cushioning means and thereby absorb energy.

A spring release means engaging and longitudinally extending between the seat means and the center wedge for continuously urging the friction cushioning means outwardly from the compressible cushioning means to release such friction cushioning element when an applied force compressing the draft gear is removed.

A coupler follower is disposed within the yoke portion during the friction draft gear assembly being in the draft condition and is adapted for movement within the follower apertures of the housing during buff travel to engage the pair of laterally spaced movable plates and the center wedge to absorb the shock energy of the railway car.

OBJECTS OF THE INVENTION

It is therefore one of the primary objects of the present invention is to provide a friction draft gear assembly which protects a railway car by absorbing shocks in both draft and buff conditions.

A further object of the present invention is to provide a friction draft gear assembly having a higher shock absorbing capacity which meets existing AAR standards.

Yet a further object of the present invention is to provide a friction draft gear assembly having more reliable operation.

Another object of the present invention is to provide a friction draft gear assembly having a higher shock absorbing capacity while fitting into a 24.62 inches long pocket.

Yet another object of the present invention is to provide a friction draft gear assembly having a longer travel in a buff condition and a shorter travel in a draft condition that incorporates integral yoke portion.

Additional object of the present invention is to provide a friction draft gear assembly having an integral yoke portion that does not utilize an all elastomeric resilient compression elements.

These and various other objects and advantages to the present invention will become more apparent to those persons skilled in the relevant art from the following more detailed description, particularly, when such description is taken in conjunction with the attached drawings and the appended claims.

DESCRIPTION OF THE PREFERRED AND ALTERNATIVE EMBODIMENTS

Figure 1:
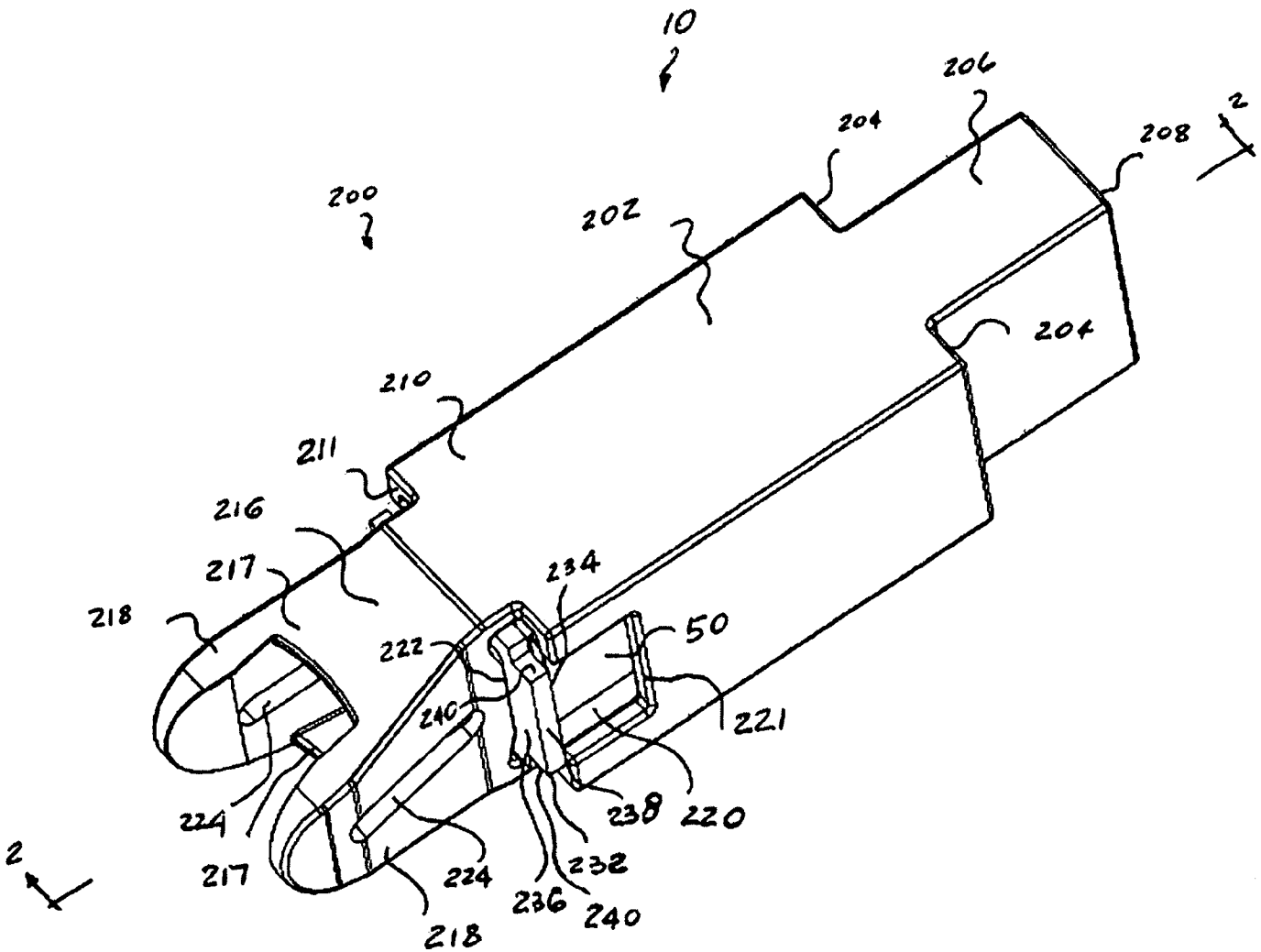
FIG. 1 is a perspective view of a friction draft gear assembly of the present invention.

Prior to proceeding to the more detailed description of the present invention, it should be noted that for the sake of clarity identical components, having identical functions have been identified with identical reference numerals throughout the several views, which have been illustrated in the drawing figures.

The present invention enables a higher shock absorbing capacity of the draft gear assembly fitting into a 24.62 inch long pocket by employing a novel housing construction having an extended rear portion enabling adaptation of a longer spring design which results in a longer buff travel in combination with an integral yoke portion and novel coupler follower to achieve shorter draft travel than friction draft gear assemblies presently in use.

To accommodate increased buff travel of 4.75 inches in the standard pocket, the coupler follower thickness was decreased to prevent coupler knuckle from hitting the striker and its front portion was further decreased to extend into the yoke portion and occupy the space of the coupler butt. This coupler follower modification also required the yoke's key slot to be moved forward giving the extra horn clearance required for the extra buff travel. Such forward movement of the coupler follower enabled the friction draft gear assembly of the present invention to accommodate additional buff travel in the standard pocket.

To reduce the amount of draft travel from 3.25 inches to between 1.250 and 1.750 inches, all four corners of the coupler follower were notched out. Consequently, all four outside corners of the open end of the housing were extended in a way enabling them to pass the coupler follower's notched corners. When the friction draft gear assembly is in full draft, the housing then contacts the front stops limiting the total draft travel. In full buff, the coupler follower passes between the four extensions located on the housing corners and contacts the housing in a manner identical to that of a standard friction draft gear assemblies presently in use.

Figure 3:
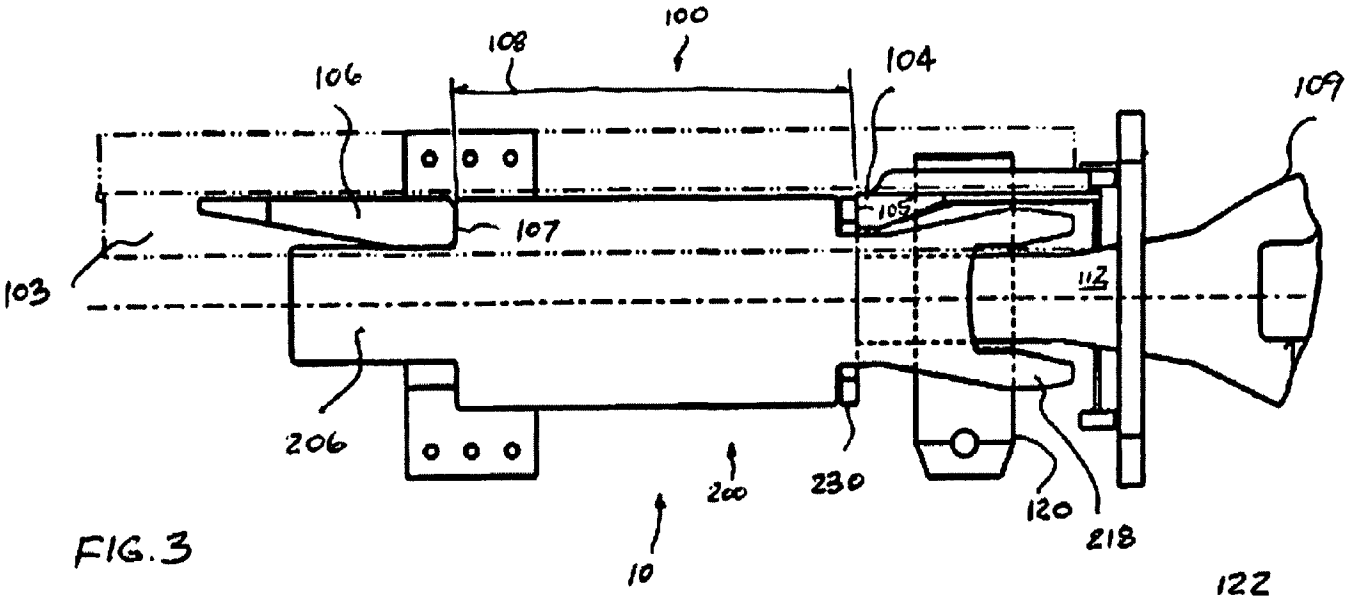
FIG. 3 is a planar view of a friction draft gear assembly of the preferred embodiment of the present invention as installed into a 24.625 inch long railway car pocket, partially illustrated.
Figure 4:
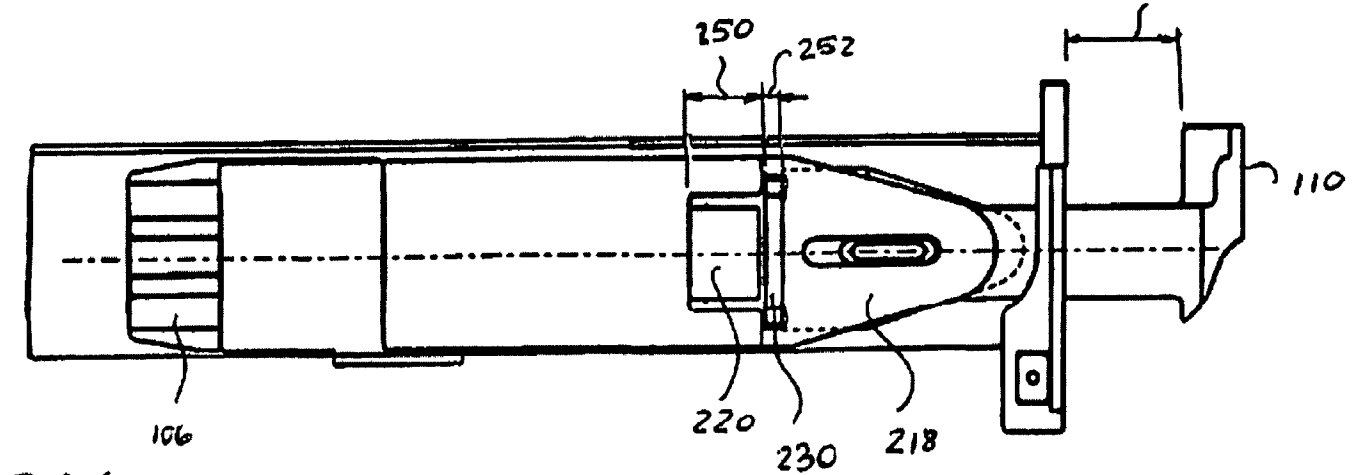
FIG. 4 is an elevation view of a friction draft gear assembly of the preferred embodiment of the present invention as installed into a 24.625 inch long railway car pocket, partially illustrated.

Referring to the present invention, as shown in FIGS. 1, 3–4, a friction draft gear assembly, generally designated 10, of the present invention includes a housing, generally designated 200, having a close end which is oriented toward the rear stops 106 and an open end which is oriented toward the coupler 109. The close end comprises a first rear portion 202 having a first predetermined cross-section and a second predetermined length and a second rear portion 264 having a second predetermined cross-section and a third predetermined length and being axially aligned with the first rear portion 202. The second rear portion 206 is disposed adjacent a bottom wall 208 which, in combination, close the end of the housing 200.

A pair of rear ledge members 204 having a first predetermined width are disposed intermediate the first and second rear portions 202 and 206 respectively and abut the pair of the rear stops 106. Such pair of rear ledge members 204 enables the second rear portion 206 of the closed end to extend into such sill 100 past the working surface 107 of the rear stops 106. It will be appreciated that such second rear portion 206 will be at least partially disposed intermediate such rear stops 106.

A first front portion 210 of the open end of the housing 200 having a third predetermined cross-section and a forth predetermined length is disposed adjacent the first rear portion 202. Such front first portion 210 is axially opposed to the closed end and is maintained in open communication therewith. Preferably, such third predetermined cross-section is equal to the first predetermined cross-section of the first rear portion 202. The first front portion 210 contains a pair of opposed first follower apertures 220 having a fifth predetermined length and a first predetermined height.

A second front portion 216 extends outwardly from the first front portion 210 and contains a pair of oppositely disposed vertical side members 218. Each vertical side member 218 contains a second follower aperture 222 of a sixth predetermined length and a second predetermined height and a longitudinally disposed aperture 224 for attachment to coupler arm 112 with a standard coupler key 120.

Preferably, a pair of oppositely disposed horizontal surfaces 217 is provided intermediate the vertical side members 218 forming a box like structure, best illustrated in FIG. 1, for reinforcing structural integrity of such vertical side members 218 during operation of the friction draft gear assembly 10.

Those skilled in the art will readily understand that a pair of opposed round apertures (not shown) may be disposed within such horizontal surfaces 217 for attachment to a coupler 109 being of a standard F-shank coupler with a coupler pin (not shown) being vertically disposed.

A pair of front ledge members 211 having a second predetermined width are disposed intermediate the first and second front portions 210 and 216 respectively and abut the working surface 105 of each of the front stops 104 with the friction draft gear assembly 10 being in a full draft position.

A coupler follower 230 has a first portion 232 of a first predetermined thickness with an inner surface 234 engageable with the end of a pair of laterally spaced movable plates 50 and the center wedge 72 of the friction draft gear assembly 10 and opposed outer surface 236 engageable with the working surface 105 of each of the front stops 104. Opposed ends 238 of the first portion 232 are provided with at least one, but preferably four, corner apertures 240 to fit within the pair of first follower apertures 220 during buff travel.

A second portion 242 fitting intermediate the pair of the vertical side portions 218 abuts the outer surface 236 at the first surface and has a second surface 240 engageable with the coupler arm 114 and the pair of front stops 104.

Figure 2A:
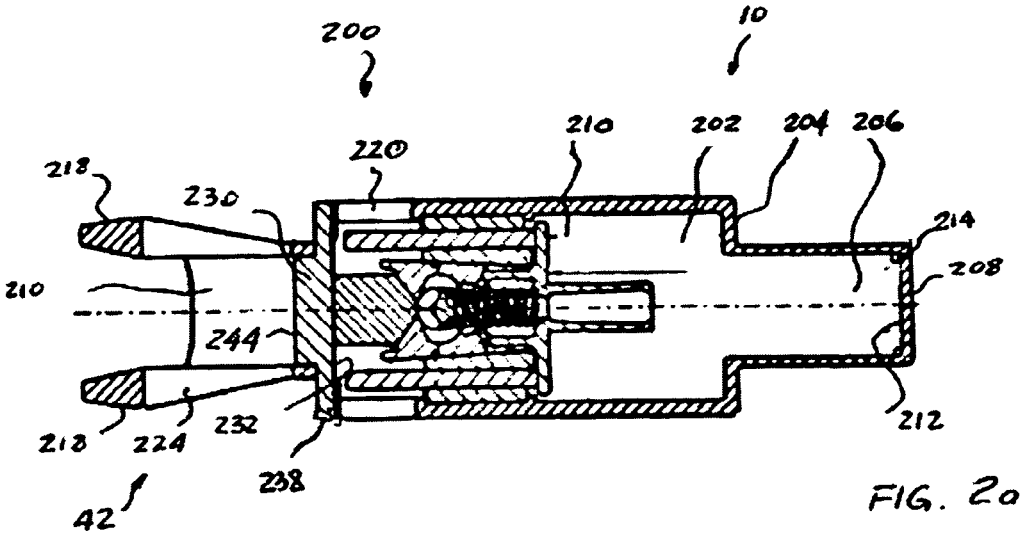
FIGS. 2*a*–2*c* are a longitudinal cross-sectional view of a friction draft gear assembly of the present invention along lines 2—2 in FIG. 1, particularly showing position of the coupler follower in a fully released, partially compressed and a fully compressed conditions.
Figure 2B:
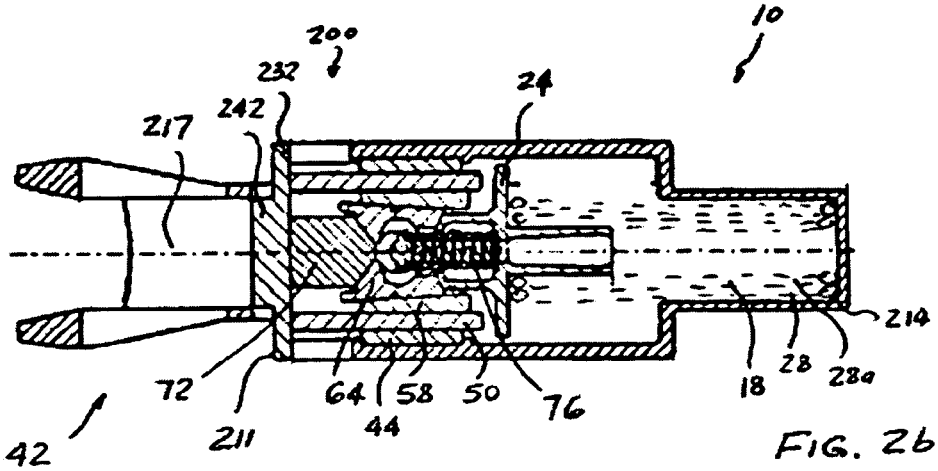
Figure 2C:
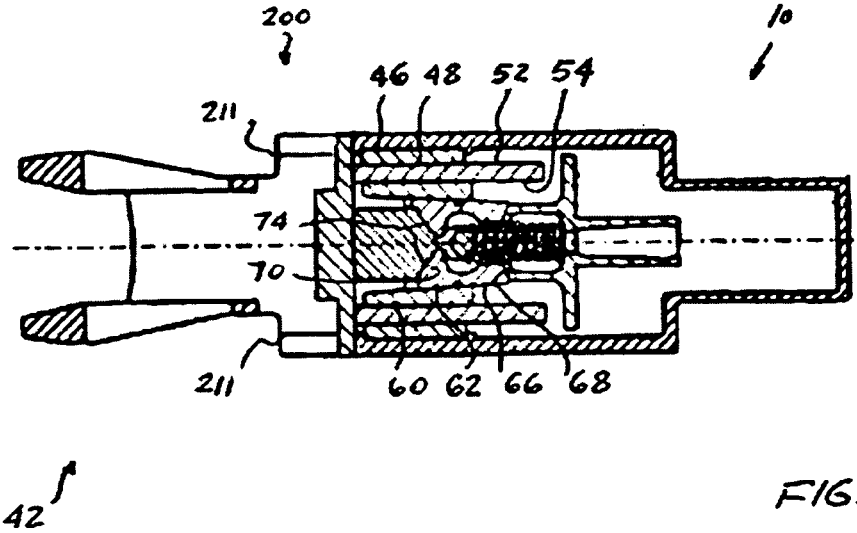

In a particular reference to FIGS. 2*a*–2*c*, the compressible cushioning means 18 is centrally disposed within the rear portion 206 and has one end thereof abutting at least a portion of an inner surface 212 of the bottom wall 208 of the housing 200.

The compressible cushioning means 18 may comprises at least one cushioning spring and a hydraulic assembly as taught by U.S. Pat. No. 3,368,698, or at least one elastomeric pad stack as taught by U.S. Pat. No. 6,488,162 and U.S. Pat. No. 6,446,820, but preferably the compressible cushioning means 18 comprises at least one cushioning spring 28 of a predetermined length, and, yet more preferably, the compressible cushioning means 18 comprises a pair of first and second resilient compression means, being a pair of first and second spring elements 28 and 28*a* respectively, best shown in FIG. 2*b*, having a first and a second predetermined spring rate respectively.

A seat means 24 abutting the pair of first and second springs 28 and 28*a* respectively is adapted within the housing 200 for longitudinal movement therein for respectively compressing and releasing the compressible cushioning means 18 during application and release of a force on the draft gear assembly 10.

The housing 200 further includes a compressible cushioning means 18 positioning means 214 disposed adjacent the inner surface 212 of the bottom wall 208 for maintaining that end of the compressible cushioning means 18 centrally located within the second rear portion 206 of the housing 200 during compression and extension of such compressible cushioning means 18.

A friction cushioning means, generally designated as 42, is disposed at least partially within the front portion 210 of the housing 200. The friction cushioning means 42 absorbs energy during application of a force sufficient to cause a compression of the draft gear assembly 10.

The friction cushioning means 42 includes a pair of laterally spaced outer stationary plates 44 having an inner friction surface 48 and an opposed outer surface 46 engaging the housing 12.

The pair of laterally spaced movable plates 50 of substantially uniform thickness having an outer friction surface 52 and an inner friction surface 54 and at least one substantially flat edge 56 intermediate the outer friction surface 52 and an inner friction surface 54 is disposed within the open end of the draft gear assembly 10. The inner friction surface 54 having an edge 56 thereof engaging the seat means 24. At least a portion of the outer friction surface 52 movably and frictionally engages the inner friction surface 48 of the outer stationary plate 44.

A pair of laterally spaced tapered plates 58 having an outer friction surface 60 and an opposed inner friction surface 62 are adapted adjacently such movable plates 50. The outer friction surface 60 movably and frictionally engages at least a portion of the inner friction surface 54 of the movable plate 50.

The friction cushioning means 42 further includes a pair of laterally spaced wedge shoes 64 which have at least a portion of an outer friction surface 66 movably and frictionally engaging at least a portion of the inner friction surface 62 of the tapered stationary plate 58. Wedge shoes 64 have at least a portion of one edge 68 engaging seat means 24 and a predetermined tapered portion 70 on an opposed edge thereof.

It has been discovered that the tapered portions 62 of the tapered plates 58 and the tapered portions 66 of the wedge shoe 64 which are tapered upwardly and outwardly from a plane substantially parallel to the longitudinal centerline of the draft gear assembly 10 must be controlled within a very close tolerance of between about 4 degrees and 5 degrees, with the optimum of generally 4.5 degrees when the compressible cushioning means 18 is a pair of the first and second springs 28 and 28*a* respectively.

The center wedge 72 having a pair of matching tapered portions 74 for engaging the tapered portion 70 of the wedge shoe 64 is provided to initiate frictional engagement of the friction cushioning means 42. The tapered portions are tapered at an angle of approximately 49.0°–50.0°, preferably at an angle of 49.5°.

The draft gear assembly 10 additionally includes a spring release means 76 engaging and extending longitudinally between the seat means 24 and the center wedge 72 for continuously urging the friction cushioning mean 42 outwardly from the compressible cushioning means 18 to release the friction cushioning means 42 when an applied force compressing the draft gear assembly 10 is removed.

In operation upon impact into a coupler knuckle 110, the buffing shock is transmitted from the coupler arm 112 through the coupler follower 230 to the central wedge 72, causing it to act through the wedge shoes 64 and thereby compress all of the cushioning elements simultaneously. These parts will furnish sufficient cushioning for light buffing shocks. After a suitable travel, however, the coupler follower 230 will abut the outer ends of the movable plates 50 introducing energy-absorbing friction between the movable plates 50 and the stationary plates 58 and 44 which have been pressed together by the action of the wedge shoes 64. As this action continues, the pressure between the adjacent surfaces of the intercalated plates has been enormously increased due to the fact that the wedge shoes 64 are loaded against the cushioning mechanism 42. The energy absorption and dissipation through friction and compression of the cushioning mechanism continues until the gear is closed including compression of cushioning element 18.

During release of the friction draft gear assembly 10, the compressible cushioning means 18 is maintained in alignment by the seat means 24.

To enable a longer buff travel 250 of 4.75 inches, in a first aspect, the closed rear end has been extended into the center sill 100. In the second aspect, the portions of the standard coupler follower that abut front stops 104 were reduced in thickness by 1.250 inches to prevent the coupler 109 from hitting the striker (not shown) of the railway vehicle (not shown), thus forming the first portion 232. In the third aspect, the longitudinally disposed apertures 224 were shifter forward toward the coupler knuckle 110 by a predetermined distance enabling additional horn clearance 122 required by the extra buff travel.

To enable a shorter draft travel 252 of 1.250 inches to 1.750 inches, a plurality of corner apertures 240 were provided within the coupler follower 230 enabling thereof to travel within the first follower apertures 220 during buff travel and to contact a bottom wall 221 thereof at the end of the full buff travel thus achieving a contact with the housing 200 similarly to operation of the presently used friction draft gear assemblies manufactured by the assignee of the present invention. Additionally, when the friction draft gear assembly 10 is in full draft, the front ledge portions 211 of the second open end contact working surfaces 105 of the front stops 104 to limit the total draft travel.

Finally, the lengths of friction components and compressible cushioning means 18 were selected to match the housing 200 and coupler follower 230 of the present invention.

It will be appreciated that a combined buff and draft travel of the friction draft gear assembly of the present invention is equal to or less than 6.50 inches thus meeting requirements of various M-901 specifications.

Figure 5:
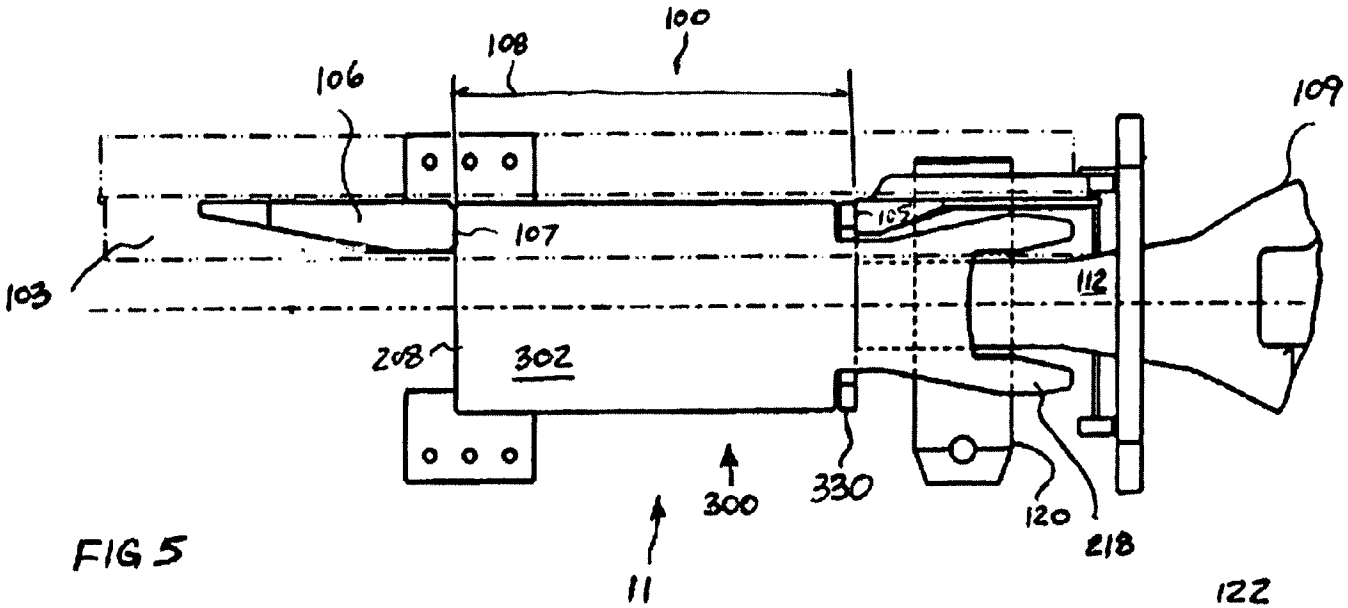
FIG. 5 is a planar view of a friction draft gear assembly of the alternative embodiment of the present invention as installed into a 24.625 inch long railway car pocket, partially illustrated.
Figure 6:
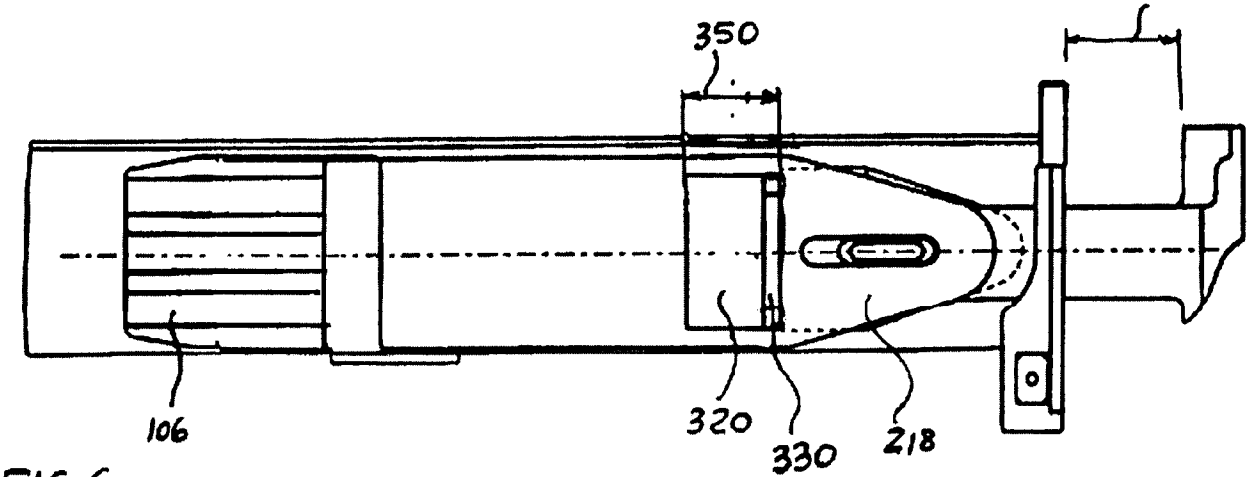
FIG. 6 is an elevation view of a friction draft gear assembly of the alternative embodiment of the present invention as installed into a 24.625 inch long railway car pocket, partially illustrated.

Those skilled in the art will readily understand that the friction draft gear assembly having and integrated yoke portion and having equal buff and draft travel will be manufactured according to the aforementioned embodiments of the present invention. Such friction draft gear assembly, generally designated 11, best shown in FIGS. 5 and 6, will include a housing 300 with a single follower aperture 320 of a predetermined depth 350 which is equal to the amount of required buff and draft travel. Such follower aperture 320 will be adapted for receiving a coupler follower 330. When the required buff and draft travel is 3.25 inches each, the housing 300 will be provided with a closed end having a single rear portion 302. Wherein, when the required buff and draft travel is 4.75 inches each, the housing 300 will be adapted with a first and a second rear portions according to the embodiments of the present invention.

Although a presently preferred and various alternative embodiments of the present invention have been described in considerable detail above with particular reference to the drawing FIGURES, it should be understood that various additional modifications and/or adaptations of the present invention can be made and/or envisioned by those persons skilled in the relevant art without departing from either the spirit of the instant invention or the scope of the appended claims.

I claim:

1. A railway car friction-type draft gear assembly which enables the cushioning of buff and draft shocks that are usually encountered in such railway car rolling stock during a coupling operation of such railway car to a train consist and during normal operation of such train consist on a track structure, such buff and draft shocks transmitted by a coupler of such railway car engageable with said friction draft gear assembly, said draft gear disposed within a center sill of such railway car between a pair of front stops and an axially opposed pair of rear stops, such pairs of front and rear stops forming a 24.625 inch draft gear pocket, said friction draft gear assembly having a longer buff travel distance and a shorter draft travel distance, said friction draft gear assembly comprising:

(a) a housing member including a first end having a first rear portion of a first predetermined crosssection and a second predetermined length, a second rear portion of a second predetermined cross-section and a third predetermined length being axially aligned with said first portion, said second portion closed by an end wall and a pair of rear ledge members having a first predetermined width disposed intermediate said first and second rear portions and abutting such pair of rear stops, and a second end having a first front portion of a third predetermined cross-section and a forth predetermined length being disposed adjacent said first portion of said first end, said second end being axially opposed to said first end and further being in open communication with said first rear portion thereof, a second front portion having a pair of vertical side members extending outwardly from said first front portion and a pair of front ledge members having a second predetermined width disposed intermediate said first and second front portions, said pair of front ledge members engageable with a working portion of each of such front stops during draft travel;

(b) a compressible cushioning means centrally disposed within said second rear portion and extending longitudinally through said first rear portion of said housing member, one end of said cushioning means abutting at least a portion of an inner surface of said end wall closing said first end of said housing member, said compressible cushioning means extending longitudinally from said inner surface of said end wall;

(c) a positioning means adjacent said inner surface of said end wall at said first end of said housing member for centrally maintaining said one end of said compressible cushioning means in said second rear portion of said housing member during compression and extension of said compressible cushioning element;

(d) a seat means having at least a portion of one surface thereof abutting an axially-opposite end of said compressible cushioning means and mounted to move longitudinally within said housing member for respectively compressing and releasing said compressible cushioning means during application and release of a force exerted on said draft gear assembly;

(e) a friction cushioning means positioned at least partially within said front portion of said housing member for absorbing energy during a compression of said draft gear assembly, said friction cushioning means including:

(i) a pair of laterally spaced outer stationary plate members having an outer surface and an axially-opposed inner friction surface, said outer surface engaging a portion of an inner surface of said housing member, (ii) a pair of laterally spaced movable plate members of substantially uniform thickness and having an outer friction surface and an inner friction surface and at least one substantially flat edge intermediate said outer friction surface and said inner friction surface, said one edge engaging said seat means, at least a portion of said outer friction surface movably and frictionally engaging said inner friction surface of said outer stationary plate member, (iii) a pair of laterally spaced tapered plate members having an outer friction surface and an inner friction surface, said outer friction surface of each said tapered plate member movably and frictionally engaging at least a portion of said inner friction surface of a respective one of said movable plate members, (iv) a pair of laterally spaced wedge shoe members having an outer friction surface, a bottom edge and an opposed edge, at least a portion of said outer friction surface movably and frictionally engaging at least a portion of said inner friction surface of a respective one of said tapered plate members, and at least a portion of said bottom edge engaging said seat means, said pair of wedge shoe members having a predetermined tapered portion on said opposed edge thereof, (v) a center wedge member, said center wedge member including a pair of correspondingly tapered surfaces frictionally engageable with an inner tapered surface of a respective one of said pair of wedge shoe members, and (vi) three lubricating means for lubricating at least three predetermined friction surfaces selected from said inner friction surface of said stationery plate members, said outer friction surface of said tapered plate members, and said outer friction surface of said wedge shoe members;

(f) a spring release means engaging and longitudinally extending between said seat means and said center wedge member for continuously urging said friction cushioning means outwardly from said compressible cushioning means to release said friction cushioning element when an applied force compressing said draft gear assembly is removed;

(g) a coupler follower including a first portion of a first predetermined thickness having an inner surface engaging said pair of laterally spaced movable plates and said center wedge of said friction draft gear assembly, an opposed outer surface engageable with a working surface of each of such front stops and a pair of opposed ends disposed intermediate said inner and said outer surfaces and adapted with a plurality of corner apertures, said coupler follower further including a second portion disposed intermediate said outer surface and said coupler arm, said coupler follower disposed for axial movement within a pair of opposed first follower apertures having a fifth predetermined length and a pair of opposed second follower apertures having a sixth predetermined length of said open second end; and (h) a means disposed within said second front portion of said second end for attachment to such coupler.

2. A friction draft gear assembly according to claim 1 wherein each of said three lubricating means includes an elongated slot and a lubricating insert member disposed within said elongated slot to prevent detrimental sticking of said friction cushioning means after closure of such friction draft gear assembly and during a release cycle thereof.

3. A friction draft gear assembly according to claim 2, wherein said lubricating insert members are formed from a mixture of a pre-selected lubricating metal and at least 2% graphite.

4. A friction draft gear assembly according to claim 1, wherein said tapered inner surface of each of said wedge shoe members is tapered at an angle of about 49.5°.

5. A friction draft gear assembly according to claim 1, wherein said first predetermined angle of said inner surface of said pair of inner stationary plate members is about 4.5°.

6. A friction draft gear assembly according to claim 1, wherein said pair of tapered surfaces of said center wedge is tapered at an angle of about 49.5°.

7. A friction draft gear assembly according to claim 1, wherein said compressible cushioning means is one of at least one spring element, hydraulic assembly, elastomeric pad stack and combination thereof.

8. A friction draft gear assembly according to claim 7, wherein said compressible cushioning means is at least one spring element having a predetermined length and a predetermined spring rate.

9. A friction draft gear assembly according to claim 8, wherein said compressible cushioning means is a pair of spring elements having a predetermined length and a first and second predetermined spring rates.

10. A friction draft gear assembly according to claim 1, wherein said fifth predetermined length of said pair of said first follower apertures is one of a larger and equal than said sixth predetermined length of said pair of said second follower apertures.

11. A friction draft gear assembly according to claim 10, wherein said fifth predetermined length of said pair of said first follower apertures is larger than said sixth predetermined length of said pair of said second follower apertures.

12. A friction draft gear assembly according to claim 1, wherein said means for attachment to such coupler include one of pair of longitudinal apertures disposed within said pair of vertical side members and pair of generally round apertures disposed within a pair of opposed horizontally disposed surfaces of said second front portion.

13. A railway car friction-type draft gear assembly which enables the cushioning of buff and draft shocks that are usually encountered in such railway car rolling stock during a coupling operation of such railway car to a train consist and during normal operation of such train consist on a track structure, such buff and draft shocks transmitted by a coupler of such railway car engageable with said friction draft gear assembly, said draft gear disposed within a center sill of such railway car between a pair of front stops and an axially opposed pair of rear stops, such pairs of front and rear stops forming a 24.625 inch draft gear pocket, said friction draft gear assembly having an equal buff and draft travel distances, said friction draft gear assembly comprising:

(a) a housing member including a first end having a first predetermined cross-section and a second predetermined length, said first end closed by an end wall, and a second end having a first front portion of a third predetermined cross-section and a forth predetermined length being disposed adjacent said first end, said second end being axially opposed to said first end and further being in open communication therewith, a second front portion extending outwardly from said first front portion and a pair of front ledge members having a predetermined width disposed intermediate said first and second front portions, said pair of front ledge members engageable with a working portion of each of such front stops during draft travel;

(b) a compressible cushioning means centrally disposed within said second end, one end of said cushioning means abutting at least a portion of an inner surface of said end wall closing said first end of said housing member, said compressible cushioning means extending longitudinally from said inner surface of said end wall;

(c) a positioning means adjacent said inner surface of said end wall at said first end of said housing member for centrally maintaining said one end of said compressible cushioning means in said first end of said housing member during compression and extension of said compressible cushioning element;

(d) a seat means having at least a portion of one surface thereof abutting an axially-opposite end of said compressible cushioning means and mounted to move longitudinally within said housing member for respectively compressing and releasing said compressible cushioning means during application and release of a force exerted on said draft gear assembly;

(e) a friction cushioning means positioned at least partially within said front portion of said housing member for absorbing energy during a compression of said draft gear assembly, said friction cushioning means including:

(i) a pair of laterally spaced outer stationary plate members having an outer surface and an axially-opposed inner friction surface, said outer surface engaging a portion of an inner surface of said housing member, (ii) a pair of laterally spaced movable plate members of substantially uniform thickness and having an outer friction surface and an inner friction surface and at least one substantially flat edge intermediate said outer friction surface and said inner friction surface, said one edge engaging said seat means, at least a portion of said outer friction surface movably and frictionally engaging said inner friction surface of said outer stationary plate member, (iii) a pair of laterally spaced tapered plate members having an outer friction surface and an inner friction surface, said outer friction surface of each said tapered plate member movably and frictionally engaging at least a portion of said inner friction surface of a respective one of said movable plate members, (iv) a pair of laterally spaced wedge shoe members having an outer friction surface, a bottom edge and an opposed edge, at least a portion of said outer friction surface movably and frictionally engaging at least a portion of said inner friction surface of a respective one of said tapered plate members, and at least a portion of said bottom edge engaging said seat means, said pair of wedge shoe members having a predetermined tapered portion on said opposed edge thereof, (v) a center wedge member, said center wedge member including a pair of correspondingly tapered surfaces frictionally engageable with an inner tapered surface of a respective one of said pair of wedge shoe members, and (vi) three lubricating means for lubricating at least three predetermined friction surfaces selected from said inner friction surface of said stationery plate members, said outer friction surface of said tapered plate members, and said outer friction surface of said wedge shoe members;

(f) a spring release means engaging and longitudinally extending between said seat means and said center wedge member for continuously urging said friction cushioning means outwardly from said compressible cushioning means to release said friction cushioning element when an applied force compressing said draft gear assembly is removed; and (g) a coupler follower having a predetermined thickness with an inner surface engaging said pair of laterally spaced movable plates and said center wedge of said friction draft gear assembly and an opposed outer surface engageable with a working surface of each of such front stops and said coupler arm, said coupler follower disposed for axial movement within a pair of follower apertures of said open second end.

* * * * *